US006230927B1

(12) United States Patent
Schoonen et al.

(10) Patent No.: US 6,230,927 B1
(45) Date of Patent: May 15, 2001

(54) AUTOMATIC DRUG DISPENSER

(75) Inventors: Albert Jozef Martinus Schoonen, Groningen; Cornelius wilhelmus Henricus Schaap, Nijmegen, both of (NL)

(73) Assignees: Consumer Health Entrepreneurs B.V.; Medimaat B.V., both of (NL)

( * ) Notice: Subject to any disclaimer, the term of this patent is extended or adjusted under 35 U.S.C. 154(b) by 0 days.

(21) Appl. No.: 09/214,870

(22) PCT Filed: Jul. 14, 1997

(86) PCT No.: PCT/NL97/00410

§ 371 Date: Mar. 9, 1999

§ 102(e) Date: Mar. 9, 1999

(87) PCT Pub. No.: WO98/02130

PCT Pub. Date: Jan. 22, 1998

(30) Foreign Application Priority Data

Jul. 15, 1996 (NL) ..... 1003596

(51) Int. Cl.[7] ..... G07F 11/00

(52) U.S. Cl. ..... 221/10; 221/13; 700/215

(58) Field of Search ..... 221/9, 10, 13, 221/123, 197, 210; 700/215

(56) References Cited

U.S. PATENT DOCUMENTS 3,917,045 * 11/1975 Williams et al. .
4,546,901 * 10/1985 Buttavazzi ..... 221/10
5,852,911 * 12/1998 Yuyama et al. ..... 221/10 X

FOREIGN PATENT DOCUMENTS

439355 * 7/1991 (EP) .
9100466 * 10/1992 (NL) .
9210985 * 7/1992 (WO) .
9525423 * 9/1995 (WO) .

* cited by examiner

*Primary Examiner*—David H. Bollinger
(74) *Attorney, Agent, or Firm*—Rothwell, Figg, Ernst & Manbeck

(57) ABSTRACT

Automatic drug dispenser for automatically dispensing at least one prepacked drug. The dispenser comprises at least one cartridge which, in use, is filled with prepacked drugs, wherein the drugs are each provided with a drug identification code and the cartridge with a cartridge identification code. There are further provided conveying means for selecting a prepacked drug from the cartridge and for subsequently conveying the selected drug from the cartridge. By means of detecting means, the drug identification code of a selected drug and a cartridge identification code of the at least one cartridge are detected and fed to a control unit for further processing.

18 Claims, 3 Drawing Sheets

AUTOMATIC DRUG DISPENSER

The invention relates to an automatic drug dispenser for automatically dispensing at least one prepacked drug in response to a prescription signal that is fed to the dispenser and comprises information about at least one prescribed drug, the dispenser comprising:

- at least one cartridge which, in use, is filled with prepacked drugs, the drugs each being provided with a drug identification code;
- conveying means for selecting a prepacked drug from the cartridge and for subsequently conveying the selected drug from the cartridge;
- detecting means for detecting a drug identification code of a drug; and
- a control unit for controlling the conveying means in response to the prescription signal and the drug identification code detected by means of the detecting means.

Such automatic dispenser is known from, inter alia, international patent application WO 95/25423. The known dispenser is used in a pharmacy system for prescribing and delivering drugs to a patient. In the known system, a doctor enters a prescription in which a prepacked drug is prescribed for a patient into an input unit, which is for instance designed as a personal computer. The input unit generates a signal which is fed, possibly via a pharmacy computer installed at a pharmacy, to the automatic drug dispenser. After reception of the prescription signal, the automatic drug dispenser will select the prescribed, prepacked drug from the cartridge by means of the conveying means. The selected product is conveyed to a position which enables detection of the drug identification code by means of the detecting means. This drug identification code is fed to the control unit. The control unit checks whether the drug identification code corresponds to the drug prescribed by means of the prescription signal. If this is the case, the drug can be conveyed, by means of the conveying means, to a location for dispensing to the patient.

It is also possible that a patient himself inputs a prescription at an input unit. In that case, too, the input unit will generate a prescription signal which is fed to the automatic drug dispenser. The input unit can then for instance be disposed directly beside the automatic drug dispenser. Of course, the input unit may also form a part of the automatic drug dispenser. The input unit can consist of a card reader capable of reading out a chipcard containing a prescription for obtaining the prescription signal. The drug desired by the patient can then directly be received for use. It is also possible that the prescription signal is inputted via an input unit disposed at the doctor's. The doctor also inputs the prescription on a chipcard of the patient. Next, the patient goes to the dispenser which reads out the chipcard by means of a card reader. The control unit then checks whether the prescription signal read out from the chipcard corresponds to the prescription signal obtained from the dispenser. When the two prescription signals correspond, the drug in question can be dispensed. Of course, this may also involve drugs that are available to the public without a doctor's and/or pharmacist's intermediation. Although the chances of the known dispenser dispensing a drug that does not correspond to the prescription signal are extremely small, the object of the present invention is to increase the reliability of the known dispenser still further. Moreover, the known dispenser has as a drawback that it does not offer any possibilities of loading the dispenser in one operation with large amounts of possibly mutually different drugs. The object of the invention is to provide a dispenser which does have this possibility and wherein the reliable operation of the dispenser is moreover optimized.

To this end, according to the invention, the at least one cartridge comprises a cartridge identification code detectable by the detecting means, wherein, in use, the detecting means detect the cartridge identification code of the at least one cartridge and feed it to the control unit for further processing.

As the at least one cartridge is designed so as to be removable from the dispenser, it in possible to load the dispenser in one operation with a cartridge which in turn comprises a large number of possibly mutually different, prepacked drugs. Because the cartridge identification code is fed to the control unit, this control unit can establish and further process the identity of the cartridge. For instance, during the selection of a drug, it can be checked whether the conveying means of the dispenser approach the proper cartridge, in which the drugs are stored that correspond to the prescription signal. In that case, the cartridge identification code is hence used for performing an additional checking operation during the selection and dispensing of the prepacked drug. However, the cartridge identification code can also be used during the loading of the automatic drug dispenser with drugs. For this purpose, the control unit can for instance comprise input means for feeding to the control unit information about the cartridge identification code of cartridges that are going to be inserted into the dispenser. Then, the dispenser itself can check, on the basis of the detected cartridge identification code, whether the correct cartridges have been inserted. It can also be established in what position the cartridges are located within the dispenser.

Preferably, the control unit comprises a data storage unit storing the cartridge identification code of the at least one cartridge, the drug identification code of the drugs with which the cartridge is filled and the position of the cartridge in the dispenser, wherein the control unit, on the basis of the prescription signal:

- determines the drug identification code of the prescribed drug;
- determines, from the data storage unit, the position of the cartridge in which the drug represented by the prescription signal is stored;
- checks whether the cartridge identification code detected at that location by the detecting means corresponds to the cartridge identification code determined for the position in question from the data storage unit; and
- checks, by means of the detecting means, whether the drug identification code, detected by the detecting means, of the drug selected by the conveying means corresponds to the drug identification code determined for the cartridge in question from the data storage unit.

In particular, the conveying means comprise a controllable gripper that is controlled by the control unit, with the detecting means comprising a first sensor mounted on the gripper.

To further improve the logistics of the provisioning of the automatic drug dispenser, according to a particular embodiment of the invention, the dispenser is loaded with at least one removable rack to which a number of cartridges are detachably connected, the dispenser further comprising at least one rack detector connected to the control unit for detecting the presence of the rack in the dispenser.

By inserting a rack having a large number of cartridges attached thereto into the automatic drug dispenser, it is provided that a very large number of drugs can be inserted into the dispenser. According to this particular embodiment, each cartridge is preferably loaded with the sane prepacked drugs. The chance of a wrong drug being selected by the apparatus is thus virtually nil. As it is, the filling of the cartridges can be performed with great precision in advance without there being a real chance or different types of drugs being loaded in one and the same cartridge. With regard to the dispensing process of the drugs, once loaded in the dispenser, it can be stated chat in this particular case, the cartridge identification code also involves an identification of the prescribed drug, because of the cartridges is loaded with the same drugs. Because the prepacked drugs themselves are further provided with a drug identification code, a double check is in fact performed by the dispenser, which minimizes the theoretical risk of an error.

The invention will now be specified with reference to the accompanying drawings, wherein.

Figure 1A:
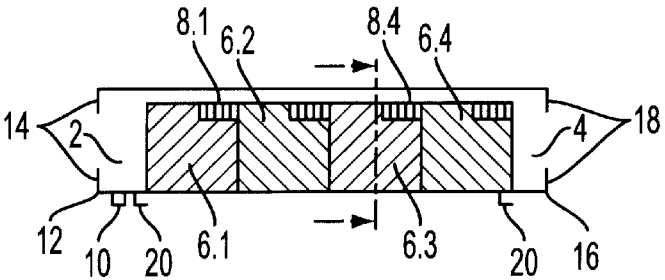
FIG. 1A shows a longitudinal section of a possible embodiment of a cartridge of an automatic drug dispenser according to the invention.
Figure 1B:
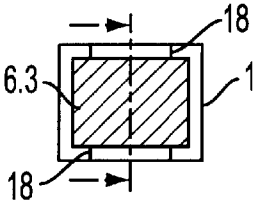
FIG. 1B shows a cross section of the cartridge according to FIG. 1A.

FIGS. 1A and 1B show a possible embodiment of a cartridge 1. The cartridge 1 has the shape of a rectangular tube section having a first and a second open end 2, 4. The cartridge 1 is loaded with a number of prepacked drugs 6.i (i =1, 2, 3, 4) arranged side by side in the longitudinal direction of the cartridge. Each of the prepacked drugs 6.i is provided with a drug identification code 8.i (i=1, 2, 3, 4). The drug identification code 8.i indicates what type of drug is involved. In this example, the drug identification codes 8.i are printed in the form of a bar code on the package of the drug 6.i. The cartridge 1 is further provided with a cartridge identification code 10. In this example, the cartridge identification code 10 consists of a passive coded transponder 10 mounted on the housing 1 of the cartridge. The passive transponder is of a generally known type which provides an identification code when it is positioned in an interrogating field.

Further, the cartridge 1 comprises, at the circumferential edge 12 of the first open end 2, a number of resilient fingers 14. The resilient fingers 14 block the first open end 2 so that the prepacked drug 6.l cannot leave the cartridge 1 via the open end 2 without an active force being exerted on the drug in question. In the drawing, the resilient fingers 14 are shown in their stable position in which they lie in the plane of the first open end 2. However, the resilient fingers 14 can be bent outwards relative to the inside of the cartridge, enabling a prepacked drug to leave the cartridge via the first open end 2.

Likewise, the cartridge 1 comprises, at the circumferential edge 16 of the second open end 4, resilient fingers 18 which, in a stable position, lie in the plane of the second open end 4 as well. However, the resilient fingers 18 are mounted so that they can be deflected in the direction of the inside of the cartridge 1. This enables loading the cartridge 1 with prepacked drugs 6.i via the second open end 4. For loading the cartridge 1, a prepacked drug 6.i can readily be pressed against the resilient fingers 18 in the direction of the inside of the cartridge. The resilient fingers will then yield, causing the prepacked drug to slide inwards via the second open end 4. As soon as the prepacked drug in question is entirely located within the cartridge 1, the resilient fingers 18 will rebound into their stable positions, so that the relevant prepacked drug can no longer leave the cartridge, at least not via the second open end 4.

The cartridge 1 further has its bottom side provided with fastening hooks 20 capable of cooperating with a rack to be discussed in more detail, so an to detachably connect the relevant cartridge to the rack.

Figure 2A:
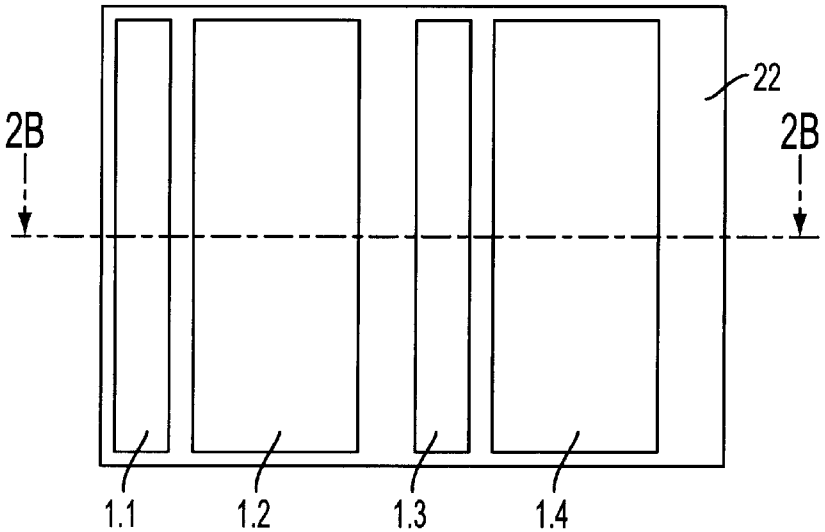
FIG. 2A is a top plan view of a number of cartridges detachably connected to a rack.
Figure 2B:
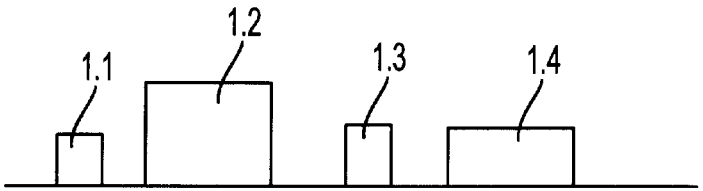
FIG. 2B shows a cross section of the rack with the cartridges according to FIG. 2A.

FIGS. 2A and 2B show a rack 22 to which a number of cartridges are detachably attached. The cartridges are designated by reference numerals 1.i (i=1, 2, 3, 4). The cartridges 1.i have dimensions adapted to the dimensions of the prepacked drugs contained therein. In this example, the rack 22 consists of a flat plate in which a number of openings are provided capable of cooperating with the hooks 20 of the cartridges 1.i for detachably attaching the cartridges to the rack 22.

Figure 3A:
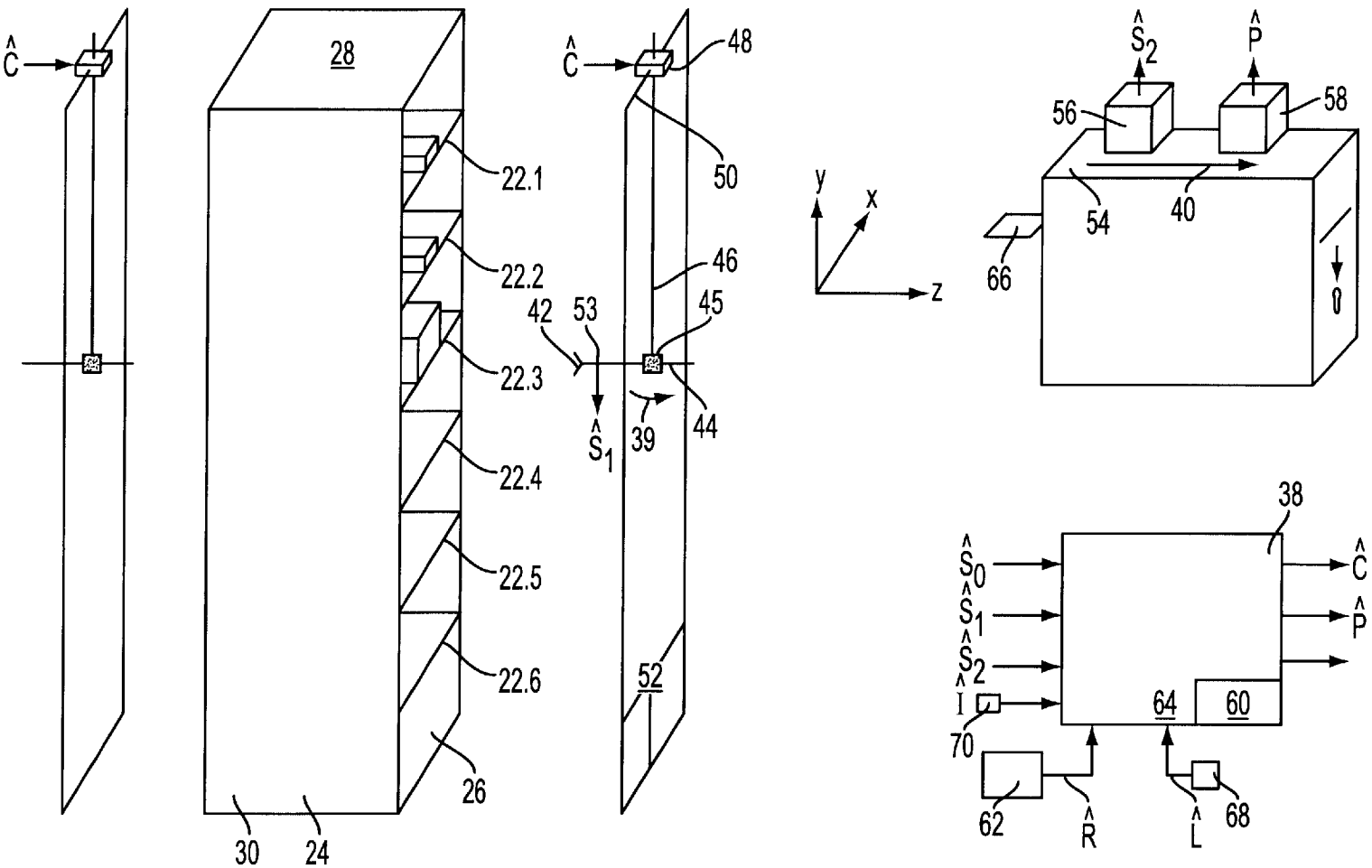
FIG. 3A is a schematic view of an automatic drug dispenser loaded with a number of racks and cartridges according to FIGS. 1 and 2.
Figure 3B:
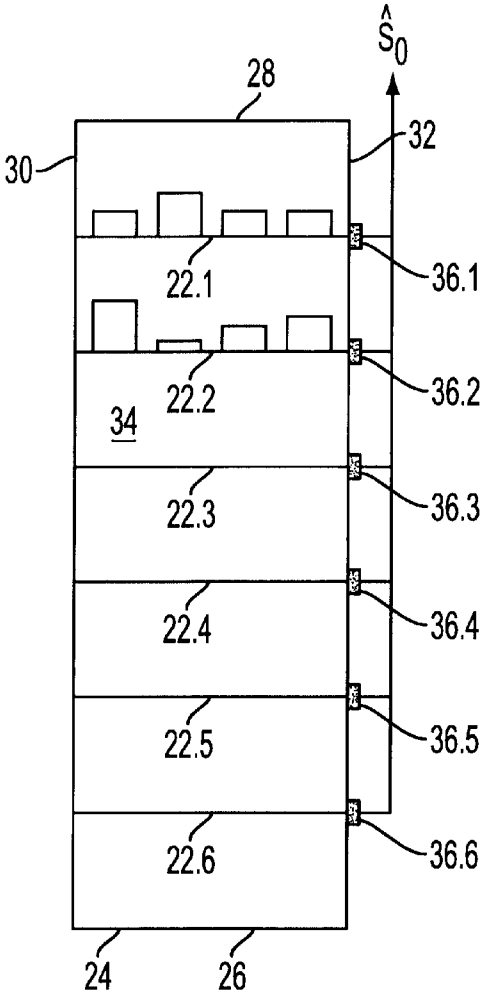
FIG. 3B is a view of a portion of an automatic drug dispenser according to FIG. 3A in the direction of the arrow P of FIG, 3A.

In use, a number of racks with cartridges, as shown in FIG. 2, are slid one above the other into a casing 24 of an automatic drug dispenser 26, as shown in FIGS. 3A and 3B.

The casing 24 consists of a bottom plate 26, a ceiling plate 28 and two vertical sidewalls 30 and 32. The vertical sidewalls 30 and 32 are each provided with guide rails 34 into which, in this example, a number of racks 22.i (i=1, 2, . . . , 6) have been slid one above the other. The casing 24 further comprises a number of rack sensors 36.i (i=1, 2, 3, . . . , 6) detecting the presence or absence of a rack. Each rack sensor generates a signal representing the presence or absence of the rack in question. These signals $\hat{S}_0$ are fed to a control unit 38 of the automatic drug dispenser for further processing.

The automatic drug dispenser further comprises conveying means in the form of a controllable gripper device 39. The controllable gripper device 39 comprises a pincer-shaped gripper 42 attached to a first sub-arm 44. Via a first driving block 45, the first sub-arm is connected to a second sub-arm 46 for rotation about a horizontal shaft perpendicular to the longitudinal direction of the first sub-arm, which second sub-arm 46 extends in vertical direction. Accordingly, the latter shaft is parallel to the X-axis shown in the drawing. Further, the first sub-arm is connected in a manner known per se to the second sub-arm 46 for movement in its longitudinal direction (the Z-direction when the first sub-arm is directed horizontally). In turn, the vertical second sub-arm 46 is connected to a second driving block 48 for movement in its longitudinal direction (the Y-direction), which second driving block is in turn arranged for sliding (in the X-direction) along a horizontal shaft 50. The horizontal shaft is approximately at the level of the ceiling plate 28 of the casing 24 and is fixedly arranged relative to the casing 24 by means of a frame 52. Through the supply of control signals $\hat{C}$ to the second driving block 48, the pincer-shaped gripper 42 can be moved in the X and Y-directions, as shown in FIG. 3A. Further, through the supply of these control signals $\hat{C}$, the first driving block 45 can be controlled for moving the pincer-shaped gripper 42 in the Z-direction. Likewise, with the supply of the control signal $\hat{C}$, the first sub-arm 49 can be rotated around the x-axis. Arranged on the side opposite the side of the casing where the frame 52 is located, is an at least substantially identical frame 52' which also comprises a horizontal shaft 50' with a second driving block 48', a second sub-arm 46' and a first sub-arm 44' connected thereto. However, instead of a pincer-shaped gripper 42, a push block 42' is mounted on the first sub-arm 44'. The push block 42' can likewise be moved in the X-Y plane under control of the above control signals Ĉ. The push block can also be moved in the Z-direction. The push block 42' and the gripper 42 are aligned relative to each other so that when the push block 42' is positioned so that it can be moved inside through movement in the Z-direction at the second open end 4 of the cartridge 1, the pincer-shaped gripper 42 is located opposite the first open end 2 of the cartridge in question. Thus, it can hereby be provided that by means of the push block 42', the prepacked drug 6.4 is pressed against, causing the prepacked drug 6.1 to be slid outside at the first open end 2. Of course, this will involve the resilient fingers 14 also being pressed outwards from the inside of the cartridge. The controllable gripper can then grip the drug 6.1, partly slid outwards, and further remove it from the cartridge.

The automatic drug dispenser further comprises detecting means in the form of a first sensor 53 mounted on the gripper 42. The dispenser further comprises a table 54 having a second sensor 56 of the detecting means provided thereon. Further, a printer 58 is provided on the table 54. In this example, the gripper device 39 is also used for conveying a drug on the table. This has as an advantage that the identity, position and orientation of the drug removed front the rack are always positively known, as long as the gripper does not release the drug. Of course, the drug on the table can also be conveyed by a conveying unit 40 schematically indicated in the drawing by an arrow 40. However, this is not preferred. The first sensor 53 provides a signal $\hat{S}_1$ which is fed to the control unit 38. The second sensor 56 provides a signal $\hat{S}_2$ which is also fed to the control unit 38. The printer is controlled by a signal P̂ generated by the control unit 38.

The control unit 38 further comprises a data storage unit 60 storing the cartridge identification codes of the cartridges located in the casing 24 as well as the drug identification codes of the drugs contained in the relevant cartridges. Further, the position of the cartridges in the dispenser, i.e. in the casing 24, is stored herein.

The operation of the system is as follows. A prescription signal R̂ is fed to the control unit 38. This prescription signal comprises information about at least one prescribed drug for a patient. The prescription signal has for instance been generated elsewhere. This can for instance be effected by means of an input unit 62 operated by a doctor. However, it is also possible that a patient himself inputs a drug at an input unit 62, after which a prescription signal is generated by the input unit 62, which signal is fed to the control unit 38. Of course, the input unit may also form a part of the automatic drug dispenser. The input unit can consist of a card reader capable of reading out a chipcard containing a prescription for obtaining the prescription signal. This prescription may have been read in on the chipcard by a doctor. In particular, the doctor can also additionally feed the prescription signal on-line to the dispenser. The control unit can then check whether the prescription of the chipcard corresponds to the prescription that was fed on-line. Certainly when these data correspond, the procedure for dispensing the drug continues as described hereinbelow.

On the basis of the prescription signal, the control unit 38 determines the drug identification code of the prescribed drug. Further, from the data storage unit 60, the position of the cartridge storing the drug represented by the prescription signal is determined. When this position is determined, the control unit 38 generates control signals Ĉ. These control signals provide that the second driving block 48 and the first driving block 45 are controlled in such a manner that the pincer-shaped gripper 42 is moved to the first open end 2 of the relevant cartridge. Simultaneously, the first driving block 45' and the second driving block 48' of the frame 52' are controlled in such a manner that the push block 42' is moved towards the second open and 4 of the same cartridge.

Next, the first sensor 53 detects the cartridge identification code of the cartridge to which it has been moved. This cartridge identification code is fed to the control unit 38 via the signal $\hat{S}_1$. The control unit checks whether the drug identification code of the drug selected by the pincer-shaped gripper 42 and detected by the first sensor 53 corresponds to the drug identification code determined for the relevant cartridge on the basis of the prescription signal from the data storage unit 60. When the cartridge identification code detected by the detecting means at that location, i.e. the identification code of the cartridge that is selected by the pincer-shaped gripper, corresponds to the cartridge identification code that is determined for the location in question from the data storage unit, the control unit controls the first driving block 45' in such a manner that the push block 42' is driven inwards via the second open end 4 of the selected cartridge. As described hereinabove, the drug 6.1 is thus pressed outwards at the first open end 2 of the selected cartridge. At the same time, the control unit 38 controls the gripper 42 in such a manner that it grips the drug, partly slid outwards, for conveying the drug from the selected cartridge to the second sensor 56. For this purpose, the pincer-shaped gripper is rotated about the X-axis by means of the first driving block 45, enabling the pincer-shaped gripper to be moved in the direction of the table 54. Thus, the selected drug is positioned on the table 54. By means of the second sensor 56, the drug identification code of the relevant drug is then determined. The identification code of the drug positioned on the table 54 is fed to the control unit 38 via a signal $\hat{S}_2$. The control unit 38 checks whether the detected drug identification code corresponds to the drug identification code determined for the relevant cartridge from the data storing means. If this is the case, the control unit controls the gripper device 39 in such a manner that the relevant drug is conveyed further to the printer 58. The printer 58 provides the drug with an inscription comprising for instance the drug, the dosage, and in particular the patient's name. This inscription can for instance be printed on a label for the drug to be released. After this, the control unit controls the gripper device 39 for further conveying and, accordingly, releasing the drug in question.

In particular, the control unit 38 generates an alarm signal when the cartridge identification code detected by the first sensor 53 at the location mentioned does not correspond to the cartridge identification code determined for that location from the data storage unit. In that case, a skilled person can check directly what is the cause of the error. No drug will then be removed from the cartridge in question. Further, the control unit 38 can be designed so that the removal of drugs from the cartridge in question is further blocked until a skilled person has investigated the matter and reset the control unit via an input 64 of the control unit. Also, the control unit 38 can be designed so that not only the cartridge whose cartridge identification code is not correct is not used any longer, but also all other cartridges mounted on the same rack.

Another error message may occur when the drug identification code detected by the second sensor 56 does not correspond to the drug identification code determined from the data storage unit 60. In that case, too, an alarm signal can be provided. The control unit then controls the pincer-shaped gripper 42 in such a manner that the drug, which is already located on the table 54, is picked up from the table 54 again and positioned at a location schematically indicated by 66 in the drawing. Hence, the drug in question is not released to a patient. Preferably, the control unit will block the further selecting and conveying of drugs from the cartridge from which the drug that caused an alarm signal was conveyed. In particular, the use of the entire rack from which the drug in question came is further blocked until a skilled person has established the cause of the error and reset the system via the input 64 of the control unit 38.

When a drug is removed from a cartridge, as described hereinabove, it is registered in the data storage unit 60. In this manner, it is at any moment known at the data storage unit 60 what cartridges are loaded with what drugs.

The control unit 38 further comprises input means, in this example the input 64 for initiating the data storage unit 60 (by loading the data storage unit with data), when the dispenser is loaded with a new rack. In the present embodiment, the above is carried out as follows. At a drug producer's or a wholesale business, cartridges are filled with predetermined drugs. These cartridges are placed on a rack. The drug identification codes and the cartridge identification codes of the rack are for instance registered on a diskette. Together with the rack, the diskette is delivered at the dispenser. The contents of the diskette are read by means of an input unit 68 and stored in the data storage unit 60. The use of a diskette can also be omitted if the drug identification codes and the cartridge identification codes are fed on-line, for instance from a wholesale business to the data storage unit 60. In this manner, the cartridge identification codes, the drug identification codes and the positions of the various drugs in the cartridges are stored at the data storage unit 60. Hence, for each drug it is known in which cartridge it is located. Moreover, if a cartridge is loaded with different types of drugs, the order of the drugs inside a cartridge is stored. Of course, this means that this information is registered on a diskette beforehand. On the other hand, if a cartridge is loaded with identical drugs, the number of the identical prepacked drugs located in the relevant cartridge is registered in the storage-unit. A user who is going to install the rack in the casing 24 also indicates, via input unit 68, at what position within the casing he intends to install the rack. This involves that in this manner, the positions of the cartridges and the associated drugs in the calling 24 are exactly known. Next, a user slides the relevant rack into the position which he had selected therefor. The relevant rack sensor 36.i then registers when the rack is inserted and provides a signal $\hat{S}_2$ to the control unit 38. If it appears that the rack is inserted into the casing at a position other than was indicated via the input unit 68, the control unit 38 will provide an alarm signal. The rack can then be removed in order to be re-inserted at the right position. Of course, it is also possible to input via the input unit 68 a new, i.e. actual, position of the rack. When the actual position of the rack eventually corresponds to the position of the rack within the casing as it is stored in the data storage unit 60, the control unit controls the first and second driving block 45, 48 in such a manner that the first sensor 53 is successively moved to the cartridges of the relevant rack. The first sensor 53 then successively reads the cartridge identification codes of the relevant rack. These identification codes are fed to the control unit 38. The control unit 38 checks whether the detected cartridge identification codes correspond to the cartridge identification codes inputted by means of the input unit 68. If the data correspond, the rack is released for use, i.e. patients have the possibility of removing drugs from the rack. If one or more of the detected cartridge identification codes proves not to correspond to the cartridge identification codes stored in the storage unit, an alarm signal is again provided, so that the rack can be checked. The control unit 38 then blocks the possibility for the patient to obtain drugs from the rack in question. In practice, the rack in question will be removed from the dispenser in order to be checked. After any errors have been rectified, the rack can be re-inserted and the initialization procedure as described hereinabove can be passed through again. Only when the detected data and the data inputted via the input unit 68 correspond to each other, the rack is released for use.

The dispenser is in particular further provided with means for establishing the identity of a patient. For this purpose, the dispenser in this exemplary embodiment comprises a card reader 70 for reading an identity card of a patient. In that case, the prescription signal also incorporates the identity of a patient. A patient going to the dispenser inserts his card into the card reader 66. The card reader determines the identity I of the patient and foods it to the control unit 38. The control unit 38 compares the patient's identity with the identity of tho patient incorporated into the prescription signal which is for instance inputted by the doctor by means of the input unit 62. When the two identities correspond, the above procedure for selecting and dispensing a drug is put into operation.

Of course, it is also possible that a number of prescription signals that comprise an identity of a patient are successively fed to the control unit 38. These prescription signals may for instance come from a number of different doctors, each of them having at their disposal an input unit 62 connected to the control unit 38. In anticipation of the patients arrival, the relevant prescription signals are stored in the data storage unit 60. When a patient subsequently applies at the dispenser to obtain his drug, he must first of all identify himself by means of his identity card. When the identity card has been read by means of the card reader 70, it is fed to the control unit 38. The control unit 38 then selects from the data storage unit the prescription or the prescription signals comprising the identity of the patient in question. After this, the above procedure for dispensing the drugs to the patient comes into operation.

The invention is by no means limited to the embodiment described hereinabove. For instance, it is possible that instead of one casing, a number of casings are positioned side by side. These casings can then be approached by one or more pincer-shaped grippers. It is also conceivable that the drugs are conveyed from the rack to the table by means of conveyor belts. These conveyor belts are for instance located directly below a rack so that when a prepacked drug is slid out of a cartridge by means of a push block 42', the relevant drug drops onto the conveyor belt. The conveyor belt system is then designed to convey the drug to the table 54 for the further processing thereof. The dispensing of a drug by the dispenser does not always imply that the drug is directly dispensed to the patient. It is also possible that the drug is deposited in a bin. In this bin, other drugs for the same patient can optionally be deposited as well. The bin itself can be provided with a bin identification code and can then be further convoyed to the patient. On the basis of the bin identification code, it can then be checked, possibly automatically, whether the proper drug or the proper drugs are dispensed to the proper patient. Also, in this manner, drugs can be dispensed to other persons or institutions being non-patients.

Such variants are all understood to fall within the framework of the invention.

What is claimed is:

1. An automatic drug dispenser for automatically dispensing at least one prepacked drug in response to a prescription signal that is fed to the dispenser and comprises information about at least one prescribed drug, wherein the dispenser. comprises:

at least one cartridge which, in use, is filled with prepacked drugs, the drugs each being provided with a drug identification code;

conveying means for selecting a prepacked drug from the cartridge and for subsequently conveying the selected drug from the cartridge;

detecting means for detecting a drug identification code of a drug; and a control unit for controlling the conveying means in response to the prescription signal and the drug identification code detected by means of the detecting means, characterized in that the at least one cartridge is designed so as to be removable from the dispenser and comprises a cartridge identification code detectable by the detecting means, wherein, in use, the detecting means detect the cartridge identification code of the at least one cartridge and feed it to the control unit for further processing.

2. An automatic drug dispenser according to claim 1, characterized in that the control unit comprises a data storage unit storing the cartridge identification code of the at least one cartridge, the drug identification code of the drugs with which the cartridge is filled, and the position of the cartridge in the dispenser, wherein, on the basis of the prescription signal, the control unit:

determines the drug identification code of the prescribed drug;

determines, from the data storage unit, the position of the cartridge storing the drug represented by the prescription signal;

checks whether the cartridge identification code detected by the detecting means at said location corresponds to the cartridge identification code determined for the position in question from the data storage unit; and checks, by means of the detecting means, whether the drug identification code, detected by the detecting means, of the drug selected by the conveying means corresponds to the drug identification code determined for the cartridge in question from the data storage unit.

3. An automatic drug dispenser according to claim 2, characterized in that the control unit controls the conveying means for dispensing the selected drug only where the detected drug identification code and the detected cartridge identification code respectively correspond to the drug identification code and the cartridge identification code determined from the data storage unit.

4. An automatic drug dispenser according to claim 2, characterized in that the conveying means comprise a controllable gripper controlled by the control unit, and wherein the detecting means comprise a first sensor mounted on the gripper.

5. An automatic drug dispenser according to claim 4, characterized in that the detecting means further comprise a second sensor, wherein the control unit, in use:

controls, on the basis of the prescription signal, the gripper towards the position of the cartridge obtained from the data storage unit;

detects by means of the first sensor the cartridge identification code of the cartridge located at the position of the gripper;

checks whether the detected cartridge identification code corresponds to the cartridge identification code stored for the position in question in the data storage unit;

controls the gripper for conveying the drug from the cartridge to the second sensor if the detected cartridge identification code corresponds to the cartridge identification code stored in the data storage space;

detects by means of the second sensor the drug identification code of the drug; and controls the gripper for further conveying the drug for dispensing the drug if the detected drug identification code corresponds to the drug identification code stored for the relevant cartridge in the data storing means.

6. An automatic drug dispenser according to claim 2, characterized in that the control unit generates an alarm signal when the cartridge identification code detected by the detecting means at said location does not correspond to the cartridge identification code stored for the location in question in the data storage unit.

7. An automatic drug dispenser according to claim 2, characterized in that the control unit generates an alarm signal when the drug identification code of the selected drug detected by the detecting means does not correspond to the drug identification code stored for the relevant cartridge in the data storage unit.

8. An automatic drug dispenser according to claim 2, characterized in that the control unit does not dispense a drug when the drug identification code of the selected drug detected by the detecting means does not correspond to the drug identification code stored for the relevant cartridge in the data storage unit.

9. An automatic drug dispenser according to claim 1, characterized in that the dispenser further comprises a printer printing, for instance on the basis of the prescription signal, the name of a patient, the drug and the dosage of the drug on a label for the selected drug to be released.

10. An automatic drug dispenser according to claim 1, characterized in that the dispenser is loaded with at least one removable rack to which a number of cartridges are detachably connected and wherein the dispenser further comprises at least one rack detector connected to the control unit for detecting the presence of the rack in the dispenser.

11. An automatic drug dispenser according to claim 10, characterized in that the dispenser comprises input means for inputting, at the control unit, information about the cartridge identification codes of cartridges attached to a new rack to be inserted into the dispenser and about the associated positions of the cartridges in the rack.

12. An automatic drug dispenser according to claim 10, characterized in that when it is detected, by means of the rack detector, that a rack is slid into the dispenser, the control unit detects by means of the detecting means the cartridge identification codes and the associated positions of the cartridges.

13. An automatic drug dispenser according to claim 11, characterized in that the control unit compares the cartridge identification codes and the associated positions detected by means of the detecting means with the information, inputted via the input means, about the cartridge identification codes and the associated positions.

14. An automatic drug dispenser according to claim 13, characterized in that the control unit generates an alarm signal when the comparison carried out by the control unit yields a difference.

15. An automatic drug dispenser according to claim 1, characterized in that the dispenser further comprises means for establishing the identity of a patient, wherein the control unit compares the patient's identity with the identity of a patient incorporated into the prescription signal.

16. An automatic drug dispenser according to claim 1, characterized in that the cartridge is filled with a number of identical prepacked drugs.

17. An automatic drug dispenser according to claim 1, characterized in that the automatic drug dispenser comprises a card reader capable of reading out a chipcard in which a prescription is stored for obtaining the prescription signal.

18. An automatic drug dispenser for automatically dispensing at least one prepacked drug in response to a prescription signal that is fed to the dispenser and comprises information about at least one prescribed drug, wherein the dispenser, in use, is loaded with at least one cartridge which, in use, is filled with prepacked drugs, the drugs each being provided with a drug identification code, wherein the dispenser comprises:

conveying means for selecting a prepacked drug from the cartridge and for subsequently conveying the selected drug from the cartridge;

detecting means for detecting a drug identification code of a drug; and a control unit for controlling the conveying means in response to the prescription signal and the drug identification code detected by means of the detecting means, characterized in that the at least one cartridge with which, in use, the dispenser is loaded, is designed so as to be removable from the dispenser and comprises a cartridge identification code detectable by the detecting means, wherein, in use, the detecting means detects the cartridge identification code of the at least one cartridge and feeds it to the control unit for further processing.

* * * * *

UNITED STATES PATENT AND TRADEMARK OFFICE

CERTIFICATE OF CORRECTION

PATENT NO. : 6,230,927 B1
DATED : May 15, 2001
INVENTOR(S) : Schoonen et al.

It is certified that error appears in the above-identified patent and that said Letters Patent is hereby corrected as shown below:

Title page,
"Cornelius wilhelmus Henricus Schapp" should be -- Cornelis Wilhelmus Henricus Schapp --

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,230,927 B1
DATED : May 15, 2001
INVENTOR(S) : Schoonen et al.

It is certified that error appears in the above-identified patent and that said Letters Patent is hereby corrected as shown below:

Title page,
Item [75], "Cornelius wilhelmus Henricus Schapp" should be -- Cornelius Wilhelmus Henricus Schaap --

Signed and Sealed this

Fifth Day of August, 2003

JAMES E. ROGAN
*Director of the United States Patent and Trademark Office*